United States Patent [19]

Cuevas

[11] Patent Number: 4,503,632

[45] Date of Patent: Mar. 12, 1985

[54] RECOIL REDUCING MECHANISM FOR SHOTGUNS

[76] Inventor: James W. Cuevas, P.O. Box 1092, Sisters, Oreg. 97759

[21] Appl. No.: 522,961

[22] Filed: Aug. 12, 1983

[51] Int. Cl.[3] ..... F41C 27/00

[52] U.S. Cl. ..... 42/1 V

[58] Field of Search ..... 42/1 V; 89/198

[56] References Cited

U.S. PATENT DOCUMENTS

| | | | |
|---|---|---|---|
| 2,679,192 | 5/1954 | Seeley et al. | 42/1 V |
| 3,018,694 | 1/1962 | Browning | 42/1 V |
| 3,650,060 | 3/1972 | Schubert | 42/1 V |
| 4,088,057 | 5/1978 | Nasypany | 42/1 V |
| 4,156,979 | 6/1979 | Katsenes | 42/1 V |

*Primary Examiner*—Charles T. Jordan

*Attorney, Agent, or Firm*—Wells, St. John & Roberts

[57] ABSTRACT

Disclosed is a recoil reducing mechanism for use in shotguns. The mechanism utilizes explosive gases from the shotgun barrel which are conveyed through gas passageways into a chamber within an attached cylinder. The cylinder is provided with a slidable piston which moves rearwardly under the pressure of the exploding gases. Gas pressure acting on a front plug of the cylinder creates a force which counteracts the recoil force of the shot shoulder. The mechanism also includes a compression spring which is rearward of the piston and between the piston and a breech plug installed in the breech end of the cylinder. The compression spring serves to return the piston into a battery position. The front end plug is provided with a resilient stop means which cushions the piston as it returns under the action of the compression spring. The invention also includes a method for converting over-under type double barrel shotguns or single barrel type combination shotguns to include the recoil reducing mechanism.

1 Claim, 4 Drawing Figures

RECOIL REDUCING MECHANISM FOR SHOTGUNS

TECHNICAL FIELD

The technical field of this invention is gas operated recoil reducing mechanisms for shotguns.

BACKGROUND OF THE INVENTION

Hunters and gun enthusiasts have for many years sought to reduce the recoil of shotguns. Trap and skeet shooters in particular are sensitive to recoil of shotguns because in tournaments they may shoot many hundreds of rounds in one day. In addition to the force which a sportsman must endure there is also the problem associated with recoil tending to raise the muzzle of the gun during firing of the shot.

The prior art recoil reducing devices have approached the problem of gun recoil in several different ways. One approach has been to generally increase the weight of the gun so that there is more inertial resistance and less recoil. Others have sought to reduce recoil by using liquid mercury which is placed in the stock of the gun and moved by the direct motion of the recoiling gun or through some mechanism. Such mercury recoil devices have generally added considerable amounts of weight to the gun usually in the buttstock. This shifts the balance of the gun rearward which to many hunters is undesirable. The liquid mercury devices have also not been as effective in reducing recoil as many sportsmen would like.

Another approach to reducing recoil is shown in U.S. Pat. No. 3,018,694 to Browning. In the Browning patent a recoil absorbing mechanism is shown for use with shotguns having a recoiling barrel. The mechanism is connected to the barrel and through a system of ports and passageways receives explosive gases from the barrel at a specific time. The pressurized explosive gases are trapped within a cylinder which acts as a shock absorber to slow and stop the recoiling barrel near the extreme limit of its rearward travel. This arrangement prevents metal to metal contact between parts in order to stop the recoiling barrel without shock.

Another approach to reducing recoil is shown in U.S. Pat. No. 3,650,062, to Schubert. The Schubert invention is an inertial recoil reducer for magazine firearms. It consists of a weight which is placed in the magazine of a shotgun. The weight is held rearwardly by a spring which is interposed between the front of the magazine and the weight. When the gun recoils the weight tends to shift forward, thereby placing additional forwardly acting force upon the gun to reduce the amount of recoil force experienced by the sportsman's shoulder.

U.S. Pat. No. 4,088,057 to Nasypany shows a gas operated recoil reducing and piston shock absorbing mchanism. The Nasypany invention has a passageway which allows explosive gases to pass from the barrel into a cylinder. A piston is slidably positioned within the cylinder and slides backwardly due to the force of the explosive gas. The piston used in Nasypany has split piston rings about the rearward end of the piston. This complicated piston sealing arrangement makes cleaning the recoil reducing mechanism relatively time consuming and difficult. It also incorporates a seal ring which is mounted in the cylinder and must be removed for cleaning. The Nasypany invention is designed to be placed above the shotgun barrel which is undesirable in most cases because of the deleterious effect on quickly sighting the gun.

The final approach shown in the prior art is U.S. Pat. No. 4,156,979 to Katsenes for a gun recoil damper. The Katsenes invention uses a large piston which is driven forwardly into a compression spring during the first part of the firing process. Before the load leaves the end of the shotgun the piston is driven backwardly by the compression spring thereby reducing the recoil which is felt during the last part of the firing cycle. The Katsenes invention is specifically directed to relieving the recoil associated with the load as it is just leaving the end of the barrel.

Although many of the prior art recoil reducing mechanisms have been effective, none have combined the high level of recoil force reduction of the current invention with the ability to easily clean the mechanism. The prior art reducing mechanisms have also been unnecessarily complicated for the level of force reduction which they have been able to achieve. The current invention solves the problem of easy cleaning and high recoil force reduction in a relatively simple and easy to construct mechanism which is economical to install and to maintain. Other objectives and advantages of the invention will be apparent from the following detailed description.

BRIEF DESCRIPTION OF THE DRAWINGS

A preferred and alternate embodiment of this invention is illustrated in the accompanying drawings, in which.

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

Figure 1:
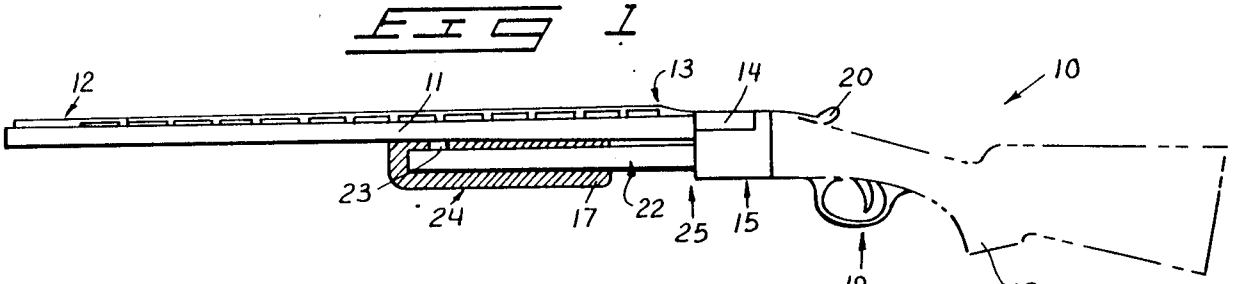
FIG. 1 is a side elevational view showing a shotgun equipped with a recoil reducing mechanism according to this invention, the forestock has been broken away and is shown in cross section.

FIG. 1 shows a shotgun incorporating the recoil reducing mechanism of this invention. Shotgun 10 has a barrel 11. Barrel 11 has a muzzle end 12 and a breech end 13. Breech end 13 is mounted in the shotgun block 14 which pivots with respect to the receiver 15. Receiver 15 is joined with the buttstock 18 which carries the trigger mechanism 19 and the breech release 20.

FIG. 1 also shows the forestock 17 broken away and shown in cross section to more clearly display the tubular cylinder 22 and saddle piece 23. Tubular cylinder 22 has a front end 24 and a rear or breech end 25.

Figure 2:
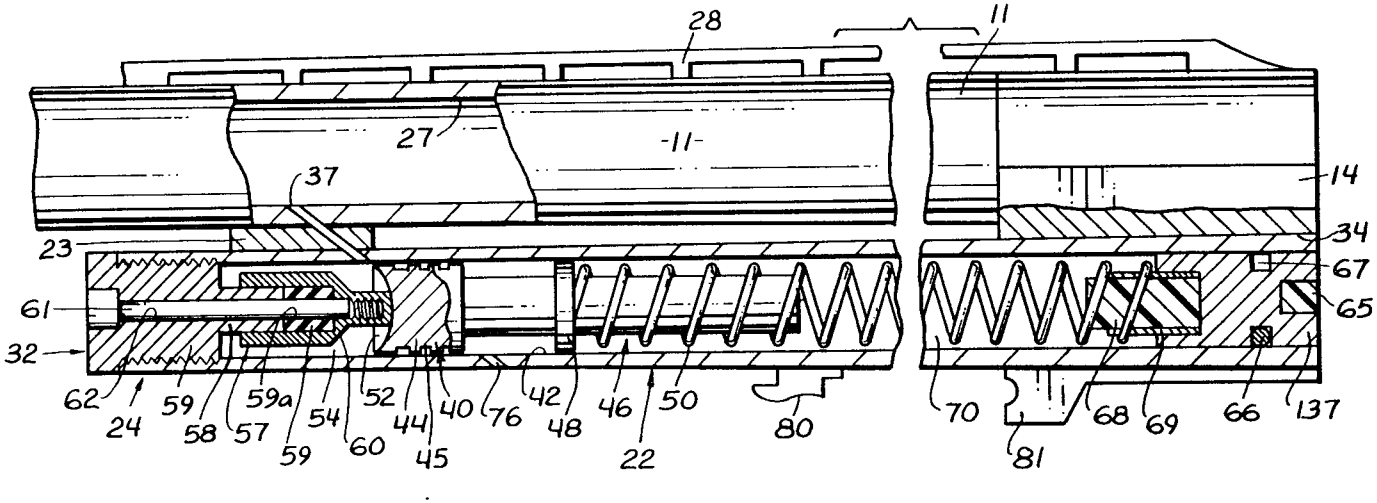
FIG. 2 is an enlarged side elevational view of the mechanism shown in FIG. 1, portions have been broken away and are shown in cross section.

FIG. 2 shows the recoil reducing mechanism of FIG. 1 in greater detail. The barrel 11 has an interior bore 27 which contains the shot being fired. FIG. 2 also shows the breech end 25 of tubular cylinder 22 inserted within a cylindrical opening 34 of block 14. The breech end of cylinder 22 is preferably held in block 14 using silver solder, although threads or other alternative means for attaching the cylinder within block 14 are possible. Cylinder 22 extends parallel to barrel 11 and is interconnected with the barrel by saddle piece 23. Saddle piece 23 is also preferably silver soldered to both barrel 11 and cylinder 22.

Saddle piece 23 serves to help support the front end of cylinder 22 and also gas passageway means 37 which extends between the interior bore of barrel 11 and the interior bore 42 of cylinder 22. Gas passageway 37 preferably is two small holes which are drilled through the side wall of cylinder 22 and also through saddle piece 23 and the side wall of barrel 11. Gas passageway 37 allows explosive gases from the barrel to expand into the interior of cylinder 22.

Cylinder 22 is provided with a front plug 32 which seals and encloses the front of cylinder 22. The breech end of cylinder 22 has a breech plug 137 which seals and encloses the breech end 25.

A piston 40 is slidably positioned within interior bore 42 of cylinder 22. Piston 40 has a piston head 44 and a piston tail 46. Piston head 44 is preferably circular in cross section and sized to provide approximately two thousands of an inch clearance between the outside diameter of the piston head and the inside diameter of the cylinder bore 42. Piston head 44 can advantageously be provided with grooves 45 which help to minimize friction and the amount of gas which can escape by piston head 44.

Piston tail 46 preferably has an outside diameter which is smaller than the outside diameter of piston head 44. A stabilizing ring 48 can advantageously be included on piston tail 46 to help stabilize the piston preventing it from becoming misaligned within cylinder interior bore 42. Stabilizer ring 48 also conveniently acts as a shoulder against which the end of compression spring 50 bears.

Compression spring 50 is mounted between piston 40 and breech plug 137 so that piston 40 will be returned into the battery position shown in FIG. 2. In the battery position the end face 52 of piston 40 contacts the front end plug 32 thereby positioning the end face just rearwardly of where gas passageway 37 intersects the interior bore of cylinder 22. End face 52 can also advantageously be concavely shaped to maximize the impulse imparted to piston 40 due to the dynamic action of explosive gas flowing through passageway 37. Piston 40 is also pushed rearwardly by the static pressure increase which occurs within chamber 54 in addition to the dynamic action of the flowing gas as it rushes from passageway 37. End face 52 can alternatively be made flat without hindering the operation of the mechanism.

Front plug 32 is preferably provided with a resilient stop means on the interior end thereof. The resilient stop means can be a simple bumper or buffer as is well known in the art or can advantageously be the mechanism shown in FIG. 2 generally indicated by 57. It includes a boss 58 that extends from the main body 59 of front plug 32. A resilient bushing 59 made from rubber or plastic or some other resilient material is located at the end of boss 58. A shroud 60 encapsulates the resilient bushing 59 and extends over boss 58 with sufficient clearance to allow the shroud to slide axially on boss 58. A socket headed cap screw or other fastener 61 extends through an opening 62 in plug 32 and opening **59*a* in resilient bushing 59. Threads are preferably provided at the rearward end of shroud 60 for receiving and securely fastening the shroud to bolt 61. This structure for the resilient stop means encapsulates the resilient bushing within a metal shroud thereby preventing deterioration of the resilient material due to the action of the hot explosive gases rushing into chamber 54. Shroud 60 also provides hoop restraint to the resilient bushing thereby helping to prevent it from busting or cracking under the impact of the returning piston 40. The resilient stop means serves to quietly and smoothly decelerate the piston as it returns under the force of compression spring 50**.

Breech plug 137 is preferably held within the breech end of cylinder 22 using a retaining pin or bolt 66. Bolt 66 is preferably a socket headed cap screw which screws into the side of block 14 through a small opening (not shown). The opening extends through the side of block 14 and through the wall of cylinder 22. Bolt 66 is received within a groove 67 which is preferably machined into the breech plug during manufacture. Breech plug 137 can alternatively be threaded or otherwise held in position.

Breech plug 137 also preferably includes a resilient bumper 68 which is held within a sleeve 69 thereby providing lateral support for the bumper. Sleeve 69 also extends into the interior of compression spring 50 to act as a guide. Bumper 68 is occasionally contacted by the tail end of piston 40 as it moves rearwardly due to the explosive action of the gases. The opposite end of breech plug 137 has a firing pin bumper 65.

Generally, piston 50 will be greatly slowed or completely stopped by the compression of gases contained within chamber 70 between the piston 44 and breech plug 137. A vent hole 76 is provided in cylinder 22 to allow explosive gases entering chamber 54 to act upon the piston head for only a short period of time and through the small axial distance between the battery position of piston 40 in FIG. 2 and the position shown in FIG. 3 wherein the end face 52 of piston 40 just passes vent passages 76. Since there are no other vents in cylinder 22, piston 40 compresses the air and gases held within chamber 70 as the piston slides backwardly. Some of the gases escape by stabilizing ring 48 and then by the piston head 44. The amount of gas which can escape by the piston head is less than the rate at which gas is being compressed within chamber 70 as piston 40 moves rearwardly. This creates a significant amount of compression in the gases within chamber 70 which serve to slow and in most cases stop the piston before it contacts bumper 68. The pneumatic deceleration of piston 40 greatly contributes to the exceedingly smooth action of this recoil reducing mechanism.

Figure 3:
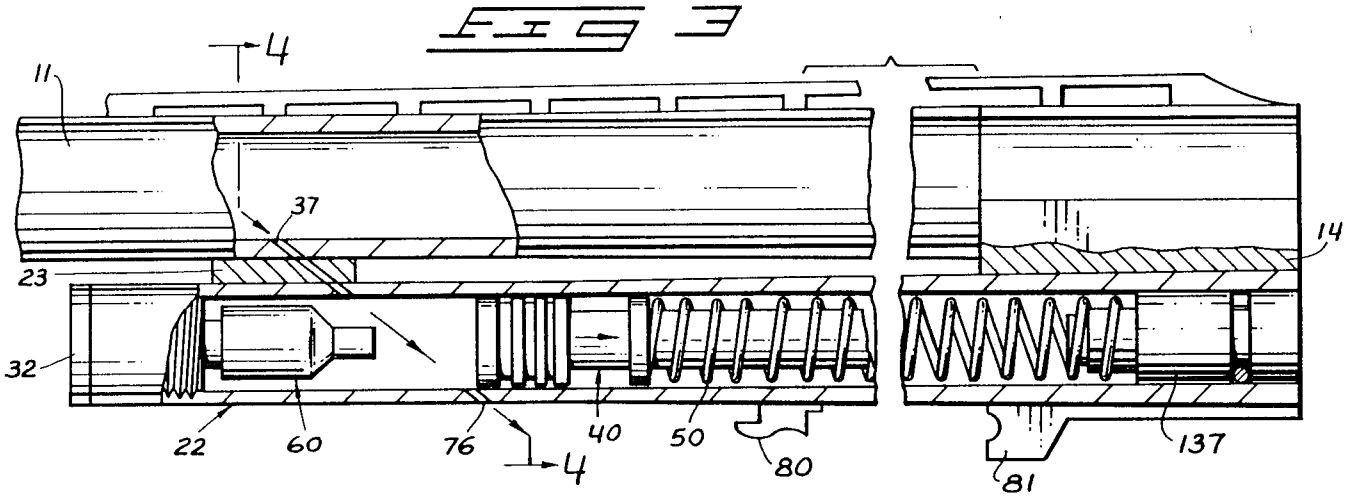
FIG. 3 is a side elevational view of the recoil reducing mechanism shown in FIGS. 1 and 2. The piston of the recoil reducing mechanism is driven partially backward by the explosive gases released when the shotgun shell is fired.

FIG. 3 shows piston 40 sliding rearwardly within cylinder 22 to a point at which vent holes 76 allow escape of the explosive gases. Little additional force is applied to piston 40 after it reaches the venting position shown in FIG. 3. The amount of gas used to operate the recoil reducing mechanism is negligible, does not perceivably affect the performance of the shotgun.

FIGS. 2 and 3 show a forestock hook 80 which allows the forestock 17 to be more securely mounted on the shotgun. Also shown is a barrel assembly hinge 81 which engages a pivot in receiver 15 thereby allowing the barrel assembly to be attached to the remainder of the shotgun.

Figure 4:
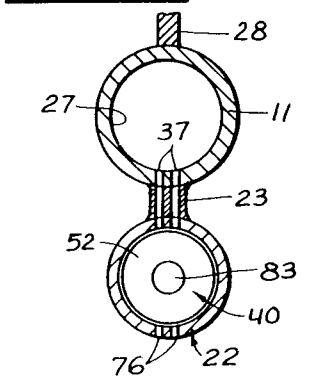
FIG. 4 is a cross-sectional view taken along line 4—4 of FIG. 3.

FIG. 4 shows that the cylinder 22 and piston 40 are preferably circular in cross-sectional shape. A flat shroud recess 83 can advantageously be provided in end face 52 of piston 40 to cause the end of shroud 60 to squarely contact the end face 52. FIG. 4 also shows there are preferably two vent holes 76 and two gas passageways 37.

This invention also includes a method of converting an over-under type shotgun or combination shotgun into a single barrel combination shotgun having a recoil reducing mechanism therein. The method first involves removing the lower barrel of an over-under shotgun or the false or pseudo-barrel of the combination shotgun from the block. A combination gun is an over-under shotgun which has been adapted for target shooting by replacing the lower barrel with a pseudo-barrel. This is done according to well known gunsmithing techniques for removing barrels. Saddle piece 23 is then connected to the barrel 11 at an appropriate location. Tubular cylinder 22 is then installed in the block of the shotgun using the opening left when the lower barrel or pseudo barrel is removed. Tubular cylinder 22 is preferably silver soldered into the shotgun block 14 and also silver soldered to the connecting saddle piece 23. It is alternatively possible to connect the tubular cylinder using threads or some other connection system.

Vent holes 76 and gas passageways 37 are then simultaneously drilled through cylinder 22, saddle piece 23 and the lower wall of barrel 11. Vents 76 and gas passageways 37 are usually drilled one at a time using a standard drill. The angle of the axis of the drill is preferably about 52° from vertical as shown in FIGS. 2 and 3, or alternatively 52° from a plane transverse to cylinder 22. Cylinder 22 can then be fitted with a front end plug 32 which is preferably threaded into the front end of cylinder 22. Front end plug 32 is preferably provided with a spanner type fitting so that the front end plug can be tightly secured within the front end of cylinder 22. Piston 40 and compression spring 50 are then slid into the interior bore 42 of cylinder 22 through the breech end of cylinder 22. The breech plug 137 can then be installed into the breech end of cylinder 22. Breech plug 137 preferably is sized so that the outside diameter of the plug is approximately equal or slightly larger than the inside diameter of cylinder bore 27 at the breech end. Retaining pin or bolt 66 is then installed through an opening (not shown) which has been previously drilled through block 14 and cylinder 22 after the cylinder was installed in the block. Breech plug 137 is thereby tightly held within the breech end of cylinder 22 to maintain adequate gas pressure between the piston 40 and the breech plug so that the piston will be pneumatically slowed and stopped.

The invention is operated by placing a shotgun shell into a gun fitted with the recoil reducing mechanism and firing the gun. Explosive gases pass through passageway 37 and into chamber 54 thereby driving piston 40 backwardly. The static pressure of the gases acts upon front end plug 32 thereby creating a force which is opposite in direction to the recoil force acting upon the breech of the gun through barrel 11. The explosive gas pressure on the end of piston 40 acts to accelerate the piston with only a small amount of that force transferred through spring 50. Thus it can be seen that the amount of force transferred through the gun to the shooter's shoulder will be significantly reduced as the piston 40 is accelerated rearwardly. Experience has indicated that very substantial and noticeable reductions in the apparent recoil force are experienced by most shotgun shooters using a gun equipped with the invention.

The piston continues rearwardly until in the position of FIG. 3 wherein the pressure of the explosive gases is released. Piston 40 continues rearwardly compressing spring 50 and compressing gas in chamber 70 until the piston stops or is stopped by bumper 68. The spring 50 then returns the piston forwardly until it strikes the resilient stop means and is in the battery position ready for the next round.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A recoil reducing mechanism for use in shotguns having a barrel with a muzzle end and a breech end, the breech end of the barrel being mounted in a block, comprising:

a tubular cylinder for connection to the shotgun in a position approximately parallel to the barrel; the tubular cylinder having an inside bore, a front end and a breech end, the breech end of the cylinder being connected to the block of the shotgun;

gas passage means interconnecting the barrel and cylinder for allowing explosive gases from the barrel to expand into the cylinder near the front end of the cylinder;

a piston slidably held within the bore of the cylinder, the piston having a relatively close fit therein;

a breech plug mounted at the breech end of the cylinder to close the breech end of the cylinder;

a front plug mounted at the front end of the cylinder, to close the front end of the cylinder; the front plug including a resilient stop means having a resilient housing connected to the front plug, a shroud surrounding the resilient bushing, and a fastener connecting the resilient bushing shroud and front plug together as an assembly; and a compression spring between the breech end of the cylinder and the piston for returning the piston toward the front end of the cylinder and into a battery position.

* * * * *